US011733006B2

(12) United States Patent
Paulson et al.

(10) Patent No.: US 11,733,006 B2
(45) Date of Patent: Aug. 22, 2023

(54) INTERNALLY PARTITIONED REVETMENT CONTAINER CONFIGURED FOR RAPID ATTAINMENT OF DEFENSE AGAINST SMALL ARMS FIRE

(71) Applicant: United States of America as Represented by The Secretary of The Army, Alexandria, VA (US)

(72) Inventors: John Paulson, Clarkston, MI (US); Brennan S Fridley, Fort Riley, KS (US); Gerrit Van Ommering, Lakeside, CA (US); Joshua M Peterson, Harker Heights, TX (US); Paul F Mlakar, Vicksburg, MS (US)

(73) Assignee: UNITED STATES OF AMERICA AS REPRESENTED BY THE SECRETARY OF THE ARMY, Alexandria, VA (US)

( * ) Notice: Subject to any disclaimer, the term of this patent is extended or adjusted under 35 U.S.C. 154(b) by 482 days.

(21) Appl. No.: 16/364,109

(22) Filed: Mar. 25, 2019

(65) Prior Publication Data

US 2020/0309487 A1 Oct. 1, 2020

(51) Int. Cl.
*F41H 5/24* (2006.01)

(52) U.S. Cl.
CPC ..... *F41H 5/24* (2013.01)

(58) Field of Classification Search
CPC . F41H 5/24; F41H 5/013; F41H 5/023; F41H 5/0492; F41H 5/026; E02B 3/108;
(Continued)

(56) References Cited

U.S. PATENT DOCUMENTS 4,530,622 A * 7/1985 Mercer ..... E02D 17/202 405/302.7
5,647,695 A * 7/1997 Hilfiker ..... E01F 8/025 405/258.1

(Continued)

FOREIGN PATENT DOCUMENTS

DE 3917756 A1 * 12/1989
DE 202006003050 U1 * 6/2006 ..... E01F 8/025

(Continued)

OTHER PUBLICATIONS

JPS61137922A_Description_202104231633 Machine Translation (Year: 1986).*

*Primary Examiner* — Patrick J Maestri
(74) *Attorney, Agent, or Firm* — Brian C. Jones

(57) ABSTRACT

A revetment container including series of compartments conjoined to form a line of compartments with each compartment including a first sub-compartment and a second sub-compartment with the two sub-compartments having differing thickness in a direction transverse to the longitudinal direction of the series of compartments and a thinner of the two sub-compartments including one or more tension bearing members to control thickness expansion of the thinner sub-compartment where the bearing member is longer than the unstressed thickness of the thinner sub-compartment and preferentially located in a top half of the height of the thinner sub-compartment. Additionally, a revetment container compartment may be provided with a sub-compartment sized to accept ballistic panels which can quickly be inserted to attain some level of protection. Furthermore a revetment contain compartment may be augmented with the addition of slat armor.

22 Claims, 12 Drawing Sheets

(58) Field of Classification Search
CPC ..... E02B 3/124; E01F 8/025; E01F 15/145; E02D 29/0208; E02D 29/025; E02D 29/0266; E02D 29/0283; E02D 29/0233; E02D 29/0241; E02D 29/0291; E04H 9/04
See application file for complete search history.

(56) References Cited

U.S. PATENT DOCUMENTS 6,036,405 A * 3/2000 Nove ..... E02D 29/0216 405/262
10,844,564 B1 * 11/2020 Burkett ..... E02B 3/108
2005/0262998 A1 * 12/2005 Ahmad ..... F41H 5/0492 89/36.02
2005/0271479 A1 * 12/2005 Irvine ..... E02B 3/066 405/284
2010/0024343 A1 * 2/2010 Eggermont ..... E02D 29/0208 52/648.1
2011/0232472 A1 * 9/2011 Kellner, Jr. ..... F41H 5/026 89/36.08
2011/0305511 A1 * 12/2011 Heselden ..... E02B 3/04 405/16
2013/0294847 A1 * 11/2013 Milton ..... E02D 29/02 405/302.7
2014/0338520 A1 * 11/2014 Bourke ..... F41H 5/023 89/36.02
2016/0168837 A1 * 6/2016 Pettey ..... E02D 29/0208 210/170.03
2019/0071827 A1 * 3/2019 Scott ..... E01F 15/148
2019/0075738 A1 * 3/2019 Manning ..... A01G 24/50

FOREIGN PATENT DOCUMENTS

DE 102010040303 A1 * 3/2012 ..... E02D 29/0208
FR 2500864 A1 * 9/1982 ..... E02D 29/0208
FR 2601399 A3 * 1/1988 ..... E02D 29/0208
FR 2823776 A1 * 10/2002 ..... E02D 29/0266
GB 1588415 A * 4/1981 ..... E02D 29/0208
JP 61137922 A * 6/1986 ..... E02D 29/0208
JP 2001248138 A * 9/2001 ..... E02D 29/0208
JP 2003342957 A * 12/2003 ..... E02D 29/0208
WO WO-9833987 A1 * 8/1998 ..... E02D 17/20

* cited by examiner (Prior Art)

INTERNALLY PARTITIONED REVETMENT CONTAINER CONFIGURED FOR RAPID ATTAINMENT OF DEFENSE AGAINST SMALL ARMS FIRE

STATEMENT OF GOVERNMENT INTEREST

Under paragraph 1(a) of Executive Order 10096, the conditions under which this invention was made entitle the Government of the United States, as represented by the Secretary of the Army, to an undivided interest therein on any patent granted thereon by the United States. This and related patents are available for licensing to qualified licensees.

BACKGROUND

Field of the Invention

The present invention relates to military fortifications and, more particularly but not exclusively perimeter walls for military bases.

Description of the Related Art

Overseas military operations often include establishment of temporary military bases in foreign countries. Such bases may be relatively large forward operating bases or smaller combat outposts. It is often the case, in the course of military operations, that such bases military bases are to be established in close proximity to enemy combatants. Once a large military force or even a smaller contingent arrives at a location, enemy combatants may soon marshal forces to attack the newly arrived military force without allowing time for fortification to be fully established. Thus, during the initial period after insertion the initial forces may be highly vulnerable to attacks by local combatants.

In past eras (e.g., during the Vietnam war) soldiers and marines used sand bags to fortify temporary bases. Individually filling and stacking sandbags was time consuming and labor intensive. In more recent military operations, so called "Hesco" barriers manufactured by Hesco Group, Ltd. of Leeds in the United Kingdom have been used. Hesco barriers included a set of rectangular (e.g. square) compartments connected together in series forming a line of compartments that serves as an exoskeleton for a wall. The Hesco barriers have walls that include panels made of crisscrossed metal wires forming a square grid which is covered on the inside with a liner. The panels are connected together at their edges using metal coils which also serve as hinges. Side walls may also be divided into two wire grid panels that are connected together with a metal coil that serves as a hinge. The provision of the metal coil hinges allows Hesco barriers to be collapsed in the manner of an accordion and be stored compactly (e.g., in the back of truck) and rapidly pulled out to full length in order to form a wall. Unlike sand bags used in earlier eras Hesco barrier can be filled using motorized earth moving equipment such as backhoes or front loaders. FIG. 1 shows a barrier perimeter wall 100 built using a series of interconnected Hesco compartments 10 in the process of being set up. A front loader 12 may be used to fill the compartments 10 with soil 11.

FIG. 2 shows a series of interconnected Hesco compartments 10 being unfolded. The provision of coil spring hinges 13 allows the interconnected Hesco compartments to be folded into a compact configuration for storage and transport. Walls 16 of the Hesco compartments include a metal mesh 14 lined with cloth 17. The Hesco compartments 10 are open at the top 15 to facilitate filling with soil.

In certain instances, such as for example in the case of small combat outposts situated far from major military bases, powered earth moving equipment such as front loaders may not be available on-site to assist in filling Hesco compartments. When a small contingent of soldiers is deployed in a remote area in which hostile forces are present it is imperative that they achieve some level of fortification as soon as possible. Enemy force scouts or enemy sympathizers in the civilian population may alert enemy forces who may quickly marshal lightly armed enemy forces for a rapid attack. Thus, it would be desirable to provide a fortification system that allows for rapid attainment of fortification of small arms fire without requiring heavy earth moving equipment for its construction. Moreover it would be desirable to provide a fortification that is more stable when initially configured for protection for small arms fire.

SUMMARY

One aspect of the present invention addresses a revetment container compartment that includes multiple sub-compartments with one particular sub-compartment being bridged in its upper half by a tension bearing member that exceeds in length the width of the unfilled (unstressed) thickness of the particular sub-compartment. The extra length and positioning of the tension bearing member in the upper half of the sub-compartment allow the sub-compartment to bulge outward and do so in a more pronounced degree in its lower half, thereby assuming a more mechanically stable configuration. The stable configuration is beneficial when at least initially, only the one particular sub-compartment (to the exclusion of other sub-compartments) is filled so as to more expeditiously attain a degree of protection against small arms fire.

Another aspect of the disclosure addresses a revetment container compartment with the provision of a particular sub-compartment that is sized to accept one or more ballistic panels. The particular sub-compartment may be provided in addition to a first sub-compartment and a second sub-compartment, one of which has a relatively lower thickness so that it may be more quickly filled with earth to attain or enhance ballistic protection.

Yet another aspect of the disclosure addresses a construction of a revetment container compartments with lattice panels interconnected with metal coils, wherein at least one of the metal coils joining two adjacent lattice panels has at least a portion that has a spring temper and is coupled to two adjacent panel and acts as a torsional spring to bias the two adjacent panels into a relative angular disposition, such that the at least one metal coil serves as both a hinge between the two adjacent panels and a torsional spring biasing element.

A further aspect of the disclosure address a revetment container compartment that is augmented with slat armor. The revetment container compartment may include lattice panels that are connected by metal coils and slat armor may be connected to the revetment container compartment by stakes that pass through the metal coils.

BRIEF DESCRIPTION OF THE DRAWINGS

Embodiments of the invention will become more fully apparent from the following detailed description, the appended claims, and the accompanying drawings in which like reference numerals identify similar or identical elements.

DETAILED DESCRIPTION

Detailed illustrative embodiments of the present invention are disclosed herein. However, specific structural and functional details disclosed herein are merely representative for purposes of describing example embodiments of the present invention. The present invention may be embodied in many alternate forms and should not be construed as limited to only the embodiments set forth herein. Further, the terminology used herein is for the purpose of describing particular embodiments only and is not intended to be limiting of example embodiments of the invention.

As used herein, the singular forms "a," "an," and "the," are intended to include the plural forms as well, unless the context clearly indicates otherwise. It further will be understood that the terms "comprises," "comprising," "includes," and/or "including," specify the presence of stated features, steps, or components, but do not preclude the presence or addition of one or more other features, steps, or components. It also should be noted that in some alternative implementations, the functions/acts noted may occur out of the order noted in the figures. For example, two figures shown in succession may in fact be executed substantially concurrently or may sometimes be executed in the reverse order, depending upon the functionality/acts involved.

In at least one embodiment, the present invention aims to provide a revetment container that allows for rapid attainment of protection against small arms fire. It provides a mechanically more stable configuration of a fortification against small arms fire.

Figure 1:
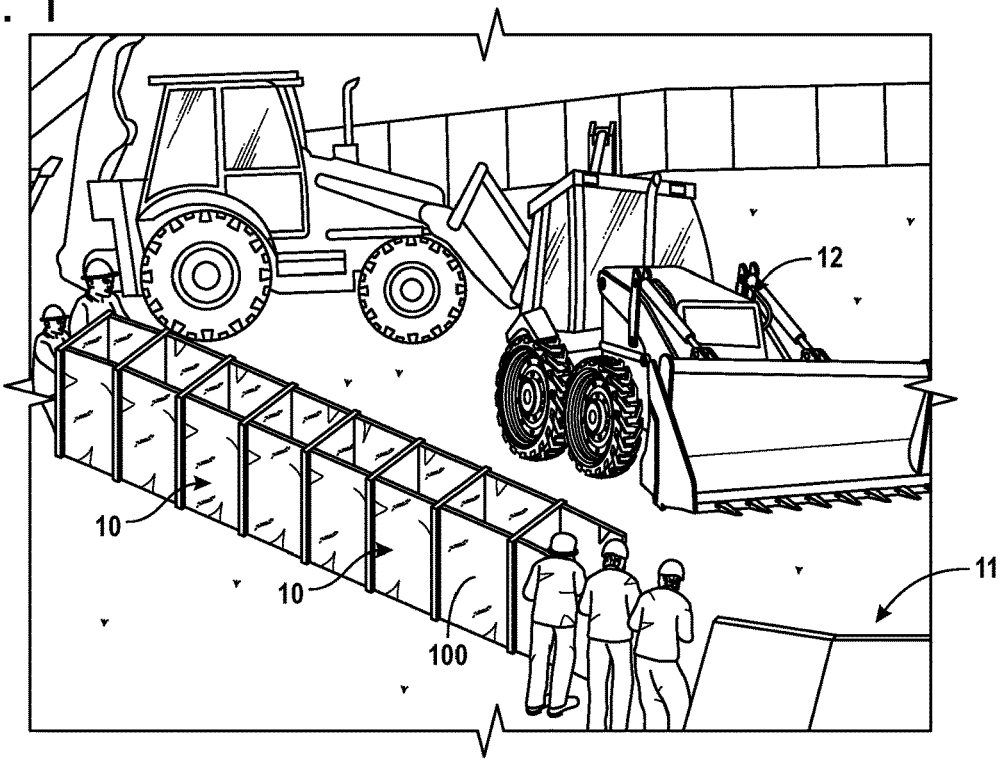
FIG. 1 depicts a scene including a Hesco barrier and front loaders used to fill the Hesco barrier.
Figure 2:
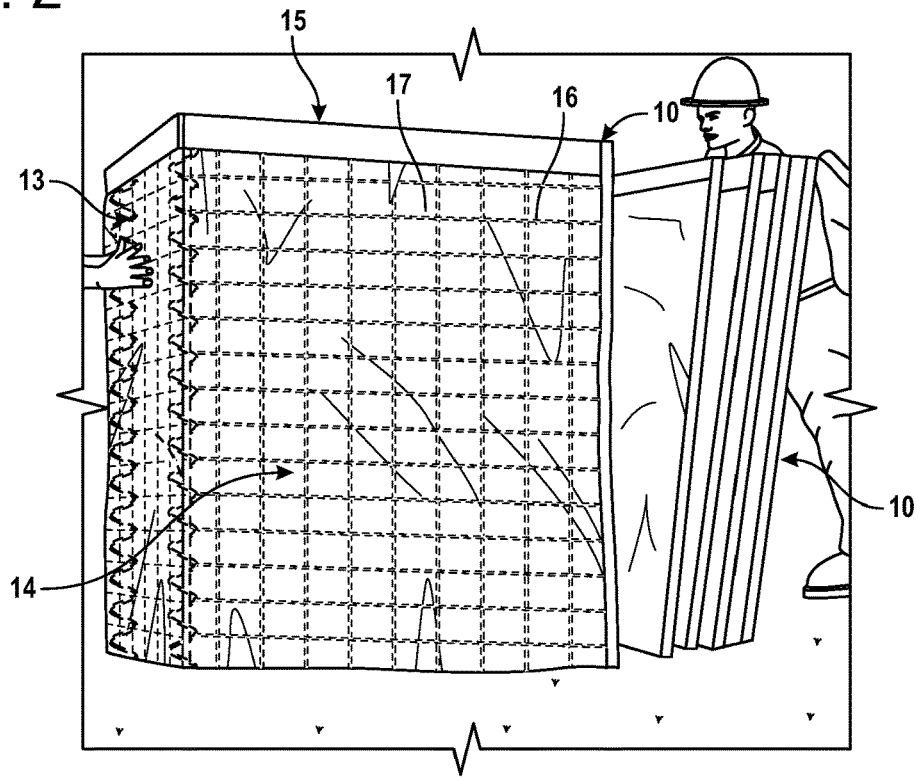
(Prior Art) FIG. 2
FIG. 2 shows a Hesco barrier in the process of being unfolded.
Figure 3:
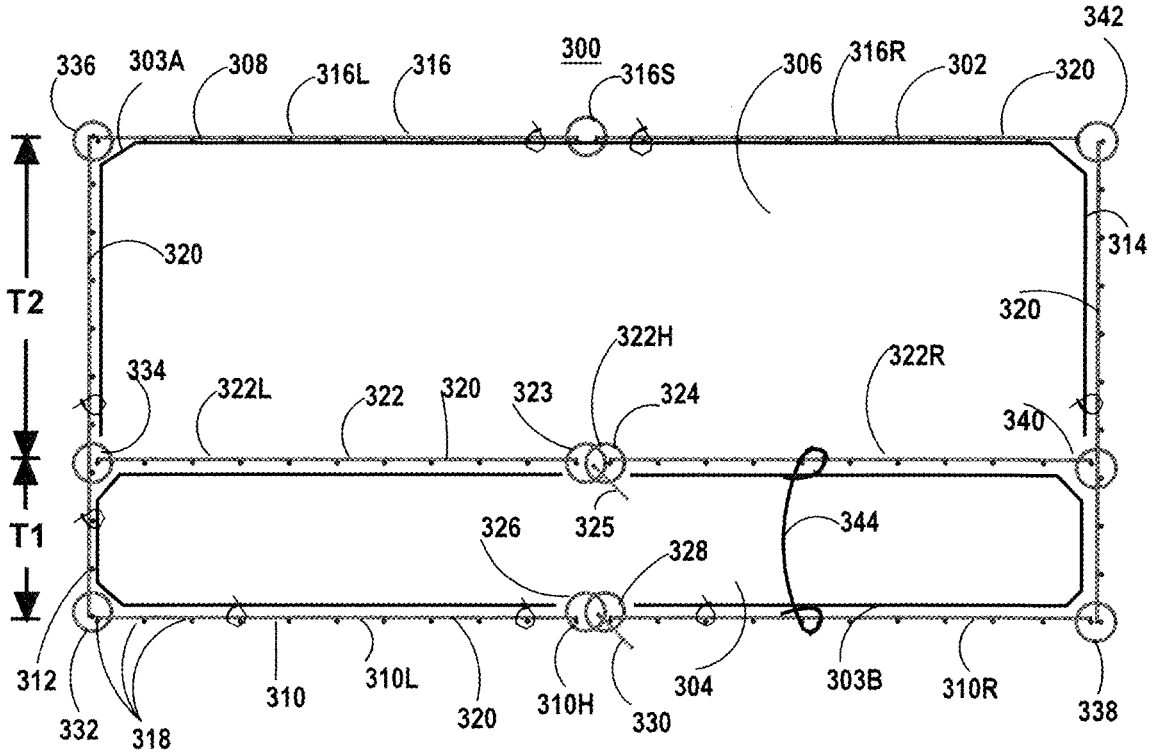
FIG. 3 is a top view of a revetment container compartment according to an embodiment of the invention.

FIG. 3 is a top view of a revetment container compartment 300 according to an embodiment of the invention. The revetment container compartment includes a metal framework 302 lined with a multi-piece earth barrier liner 303A, 303B. The compartment 300 includes a first sub-compartment 304 having a first thickness T1 and a second sub-compartment 306 having a second thickness T2. The thicknesses T1, T2 are measured horizontally when the revetment container compartment 300 is in the position in which it is used. When the revetment container compartment 300 is used as part of a set of conjoined like revetment containers (shown in FIG. 4 and FIG. 10) the direction in which the aforementioned thicknesses are measured will extend from a friendly (protected) 310 side to a hostile side 316 of the revetment container compartment 300. Although thinner, the first sub-compartment 304 has a thickness that is selected to be sufficient to stop selected types of small arms fire such as, for example from 7.62×39 AK47 bullets, 7.62×63 sniper rifle bullets, 7.62×54 Dragunov bullets and 7; 0.62×51 FNM240 bullets when the first sub-compartment 304 is filled with earth. For example in certain cases the first sub-compartment 304 has a thickness T1 of at least 6 inches (15.24 cm) and in other embodiments the first sub-compartment 304 has a thickness T1 of at least 11 inches (27.94 cm). It is thought that a thickness of 12 inches (30.48 centimeters) is an appropriate thickness for a layer of earth for providing protection against small arms fire. As will be discussed further below provisions are made to provide a more mechanically stable configuration such that when the first sub-compartment 304, but not the second sub-compartment is filled with earth a more mechanically stable configuration is achieved.

The metal framework 302, includes a peripheral wall 308 that includes a front wall 310, a left side wall 312, a right side wall 314 and a rear wall 316. The compartment 300 may be placed so that the front wall 310 is the friendly side wall. The latter arrangement would facilitate filling the first sub-compartment while minimizing exposure of personnel to the view of enemy forces. Each of the foregoing parts of the peripheral wall 308 takes the form of one or more lattice panels. When the compartment 300 is conjoined with a set of other compartments forming a line of compartments (see FIG. 4 and FIG. 10) which will be the framework of a fortification wall, one or both of the left side wall 312 and right side wall will be shared in common with an adjoining compartment and serve as a dividing wall between the adjoining compartments. As shown the lattice panels include a set of spaced vertically extending wires 318 (a limited number of which are labeled to avoid crowding the drawing) crisscrossed by a set of spaced horizontally extending wires 320 (a limited number of which are labeled to avoid crowding the drawing). In the top view perspective of FIG. 3 the vertically extending wires extend into the plane of the drawing sheet. The vertically extending wires 318 and the horizontally extending wires 320 can, by way of nonlimiting example, be woven together, welded to each other or connected by tie wires. Moreover the directions of the wires need not be vertical and horizontal. Additionally, rather than using panels assembled from discrete wires, the lattice panels may be made with foraminous sheet metal made by punching openings in sheet metal using a punch press. Furthermore the metal lattice panels can be replaced with sheets of materials (e.g., metal, plastic) which may or may not have holes.

The peripheral wall 308 bounds the compartment 300. An inner septum wall 322 extends across the compartment 300 between the left side wall 312 and the right side wall 314 dividing the compartment 300 into the first sub-compartment 304 from the second sub-compartment 306. The front wall 310 includes a left front wall panel 310L and a right front wall panel 310R. The inner septum wall 322 includes a septum wall left panel 322L and a septum wall right panel 322R. The rear wall 316 includes a rear wall left panel 316L and a rear wall right panel 316R.

A rear wall coil spring 316S is threaded through adjacent edges of the rear wall left panel 316L and the rear wall right panel 316R thereby joining the two panels 316L, 316R and acting as a hinge allowing the rear wall 316 to be folded when the compartment 316 is collapsed for storage.

The septum wall left panel 322L is joined to the septum wall right panel by an openable hinge 322H that includes a left coil spring 323 threaded through the septum wall left panel 322L, a right coil spring 324 threaded through the septum wall right panel 322R and a first removable pin 325 that passes through the left coil spring 323 and the right coil spring 324. Each of the coil springs 323, 324 coils around one of vertically extending wires 318 of their associated panel. Note that the right edge of the septum wall left panel 322L is sufficiently close to the left edge of the septum wall right panel 322R so that the left coil spring 323 and the right coil spring 324 intermesh but do not interlock. The removable pin 325 is inserted through the left coil spring 323 and right coil spring 324 locking the two coil springs 323, 324 together.

The left front wall panel 310L and the right front wall panel 310R are connected by an openable hinge 310H of the same design as the openable hinge 322H of the septum wall 322 as described above. Accordingly the openable hinge 310H includes a left coil 326 engaged with the left front wall panel 310L and a right coil 328 engaged with the right front wall panel 310R. The left and right coils 326, 328 intermesh and do not interlock but are coupled together by a front wall removable pin 330 that passes through both coils 326, 328. The left coil 326 and the right coil 328 are coiled about vertically extending wires 318 of their associated panels, respectively, the left front wall panel 310L and the right front wall panel 310R.

It may be necessary in the course of military operations to revise the placement of fortifications. For example it may be desirable to enlarge or shrink a particular forward operating base or combat outpost. The openable hinges 322H, 310H facilitate disassembly and reuse of a fortification made of compartments 300. First the pin 330 is removed from the front wall openable hinge 310H and earth filling the first compartment 304 allowed to spill out. Next the pin 325 of the septum wall openable hinge 322H is removed and earth filling the second compartment 306 allowed to spill out. Once the earth has spilled out, it will be easier to move the compartment 300.

According to an alternative embodiment the rear wall 316 rather than the front wall 310 is provided with an openable hinge. Such an alternative embodiment may be arranged such that the rear wall 316 is on the friendly side. In this case having an openable hinge on the rear wall would allow the rear wall to be more easily opened which would facilitate access to the first sub-compartment 304 for filling. The first sub-compartment 304 is, in certain embodiments, by design smaller than the second sub-compartment 306 so the first sub-compartment may be more quickly and easily filled without powered earth moving equipment, for example using a shovel.

Referring again to FIG. 3, the left front wall panel 310L, the left septum wall panel 322L and the left rear wall panel 316L are coupled to the left side wall 312 by, respectively, a front left coil 332, a septum left coil 334 and rear left coil 336 which encircle vertically extending wires 318 of adjacent panels forming hinged joints. Similarly the right front wall panel 310R, the right septum wall panel 322R and the right rear wall panel 316R are coupled to the right side wall 314 by, respectively, a front right coil 338, a septum right coil 340 and rear right coil 342 which encircle vertically extending wires of adjacent panels forming hinged joints.

When not in use the compartment 300 can be collapsed accordion style so as to require less volume for storage. The compartment 300 is suitably collapsed by initially pulling the centers of front wall 310 and the inner septum wall 322 outward (down in the perspective of FIG. 3), pulling the center of the rear wall 316 outward (up in the perspective of FIG. 3) and pushing the left side wall 312 and the right side wall 314 toward each other. Alternatively the inner septum 322 wall may be pulled in the same direction as the rear wall 316. A set of interconnected compartments (see FIG. 4 and FIG. 10) may be collapsed and stored together. In one use case a set of interconnected compartments are stored in the collapsed state in the back of the truck, from which the set may be deployed into position by securing the end of the set while moving the truck forward.

A tension bearing member 344 couples inner septum wall 322 to the front wall 310 bridging the first sub-compartment 304. The tension bearing member 344 serves to constrain the thickness direction expansion of the first sub-compartment 304 particularly when only the first sub-compartment 304 is being filled in order to more rapidly create a fortification against small arms fire. In certain embodiments the tension bearing member 344 has a length that exceeds the dimension of portions of the side walls 312, 314 spanning between the inner septum wall 322 and the front wall 310. In certain embodiment the tension bearing member has a length that exceeds the dimension of portions of the side walls 312, 314 spanning between the inner septum wall 322 and the front wall 310 by between 15% and 25%.

The tension bearing member 344, may by way of nonlimiting example, take the form of mechanical wire, or cord including parachute cord and may be rigid or elastic. In the configuration shown in FIG. 4 which corresponds to an ideal unfilled configuration the dimension of the portions of the side walls 312, 314 spanning between the inner septum wall 322 and the front wall 310 is equal to thickness T1. Note however that when the first sub-compartment 304 is filled with earth in order to create a barrier against small arms fire, the shape of the first sub-compartment 304 will distort. The distortion that occurs is partly determined by the tension bearing member 344. According to certain embodiment the tension bearing member 344 is coupled to the front wall 310 and the inner septum wall 322 in the upper one-half of the height of the first sub-compartment 304. Coupling the tension bearing member 344 in the upper one-half of the height of the first sub-compartment 304 serves to preferentially limit the expansion of the thickness of the first sub-compartment 304 in the upper one-half of the height of the first sub-compartment 304. However it should be noted that because, in certain embodiments the length of the tension bearing member 344 exceeds the dimension T1 as discussed above, or as the case may be because the tension bearing member 344 is elastic, some expansion of the thickness of the upper half of the first sub-compartment 304 will occur. The placement of the tension bearing member 344 in the upper half, by preferentially limiting thickness of the first sub-compartment 304 in the upper half, will lead to the first sub-compartment assuming a tapered configuration with a greater thickness at the base relative to the top when filled with earth. Such a configuration will be more mechanically stable and less prone to toppling when, according to the exigencies of military operations, initially, only the first sub-compartment is filled in order to rapidly attain protection against small arms fire.

Figure 4:
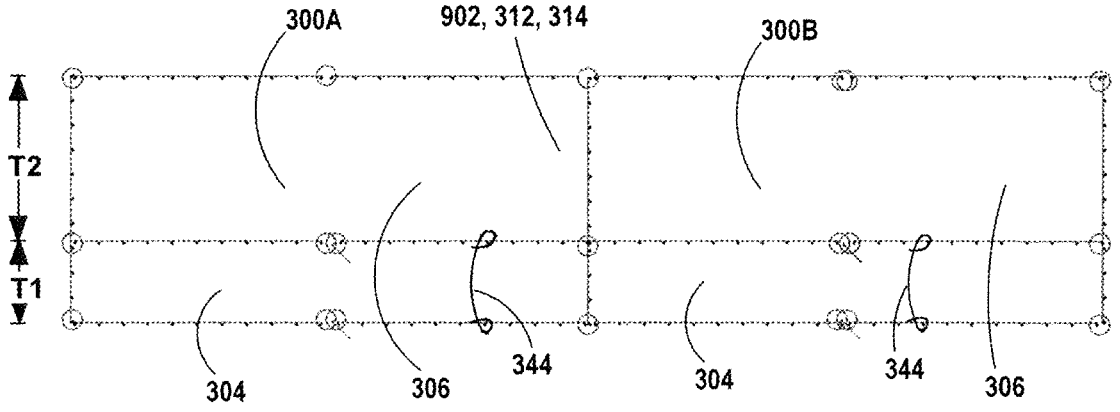
FIG. 4 is a top view of the metal framework of two interconnected revetment containers of the type shown in FIG. 3 forming a portion of a fortification wall according to an embodiment of the invention.
Figure 9:
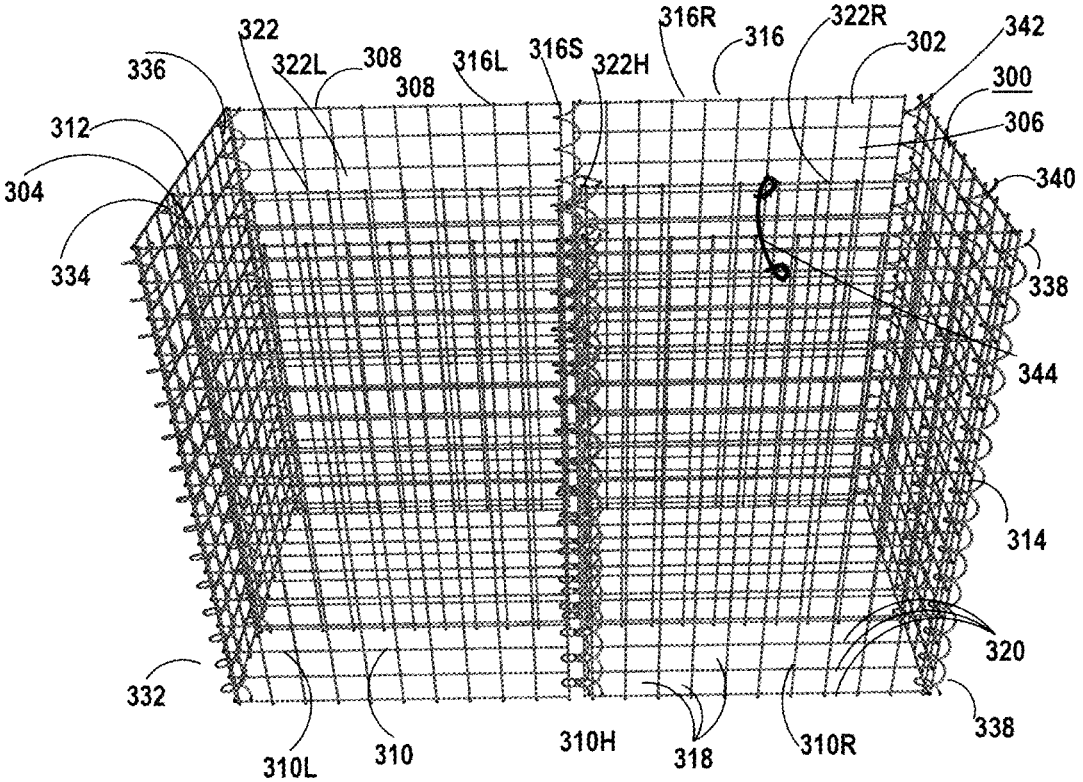
FIG. 9 is a perspective view of the revetment container compartment shown in FIG. 3.
Figure 10:
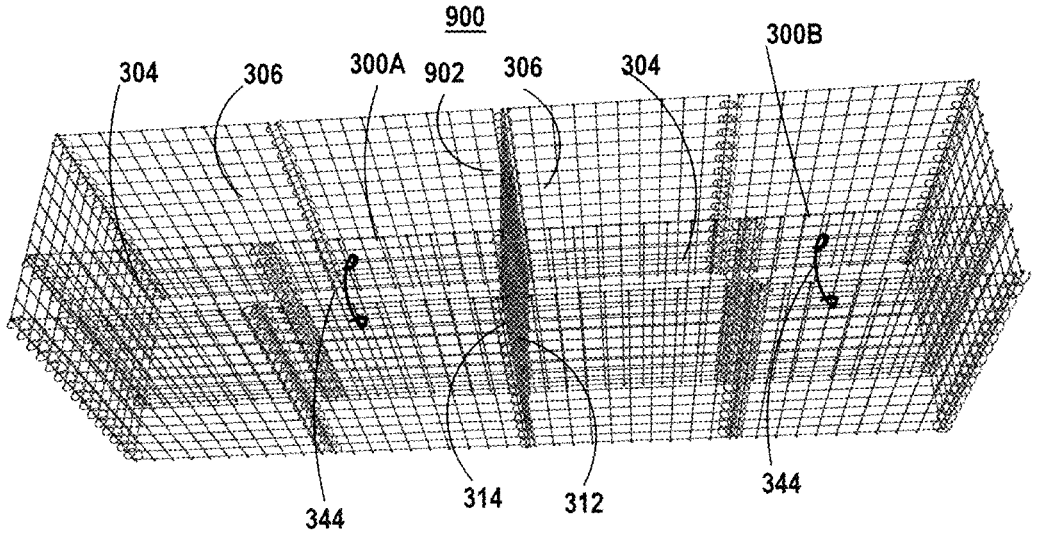
FIG. 10 is a perspective view of two interconnected revetment container compartments of the type shown in FIG. 3 according to an embodiment of the invention.

FIG. 4 is a top view of the two interconnected revetment containers of the type shown in FIG. 3 forming a portion of a fortification wall according to an embodiment of the invention. A first compartment 300A and a second compartment 300B are separated by a dividing wall 902 which serves as the right side wall 304 of the first compartment 300A and as the left side wall 306 of the second compartment 300B. Although only the two compartments 300A, 300B are shown in FIGS. 9-10 for the purpose of illustration, in practice more than two compartments would be connected in a series to form a revetment container wall for fortification of a military installation.

Figure 5:
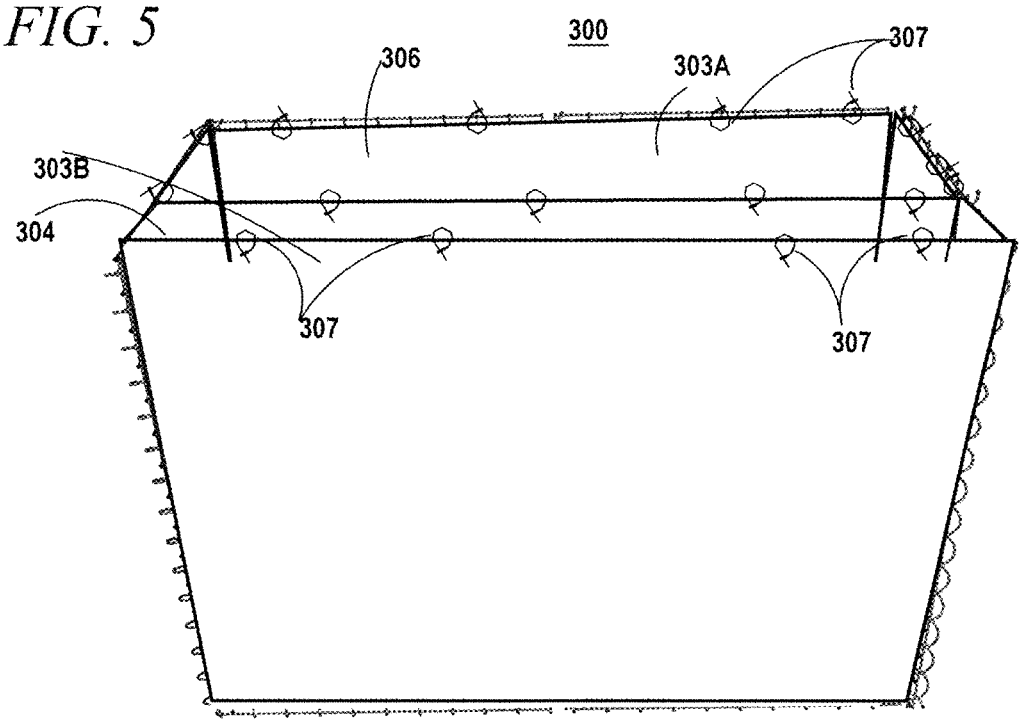
FIG. 5 is a perspective view of the revetment container compartment shown in FIG. 3 with its liner shown in place.

FIG. 5 is a perspective view of the revetment container compartment 300 shown in FIG. 3 with its liner 303A, 303B shown in place. A first liner 303A lines the first sub-compartment 304 and a second liner 303B lines the second sub-compartment 306. The liners 303A, 303B may, be made of a variety of materials. Canvas is low cost, relatively low mass and functions well to contain earth filling the compartment. In lieu of canvas fabrics with antiballistic properties may be used. Examples of materials with antiballistic properties that may be used include aramid fiber cloth (e.g., Kevlar® made by DuPont of Wilmington Del.) and spider silk. As a further alternative heavy plastic sheeting may be used as the liner 303A, 303B. As yet another alternative sheet metal such as titanium or steel sheet metal may be used as the liner. The liner may 303A, 303B may be laid against the coil springs 323, 324, 325, 326, 328, 332, 334 inside the sub-compartments 304, 306 are alternatively liner 303A, 330B may be prepared with a row of holes (not shown) so that the aforementioned coil springs may be threaded through the row of holes at the same time that the coil springs are threaded through the panels of the compartment 300. It should be noted that in the case the that the materials of the liners 303A, 303B have anti-ballistic properties in the configuration of the compartment 300 including inner septum wall 322 such anti-ballistic properties will be compounded because, generally a bullet fired by enemy forces would need to traverse three layers of the liner in order to reach the protected friendly side. As shown the liner 303A, 303B is attached to the metal frame work 302 using zip ties 307 (a limited number of which are numbered to avoid crowding the drawing).

Figure 6:
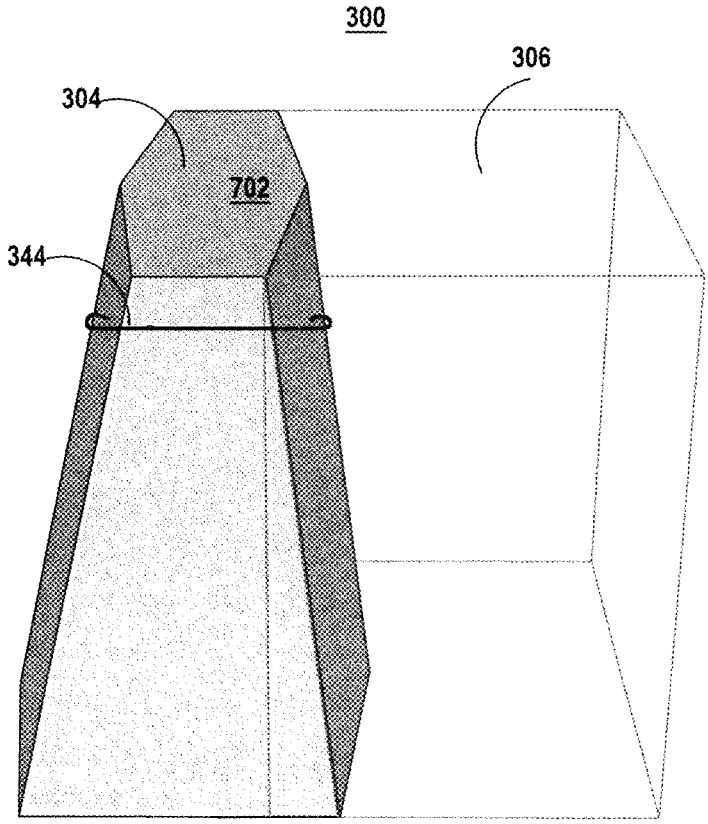
FIG. 6 is a schematic representation illustrating a shape that a sub-compartment of the revetment container compartment shown in FIG. 3 may assume when filled with soil to achieve protection against small arms fire.

FIG. 6 is a schematic representation illustrating a shape that the first sub-compartment 304 of the revetment container compartment 300 shown in FIG. 3 may assume when filled with soil to achieve protection against small arms fire. The pressure exerted by earth filling 702 the first sub-compartment 304 causes the front wall 310 bounding the first sub-compartment 304 and the inner septum wall 322 bounding the first sub-compartment 304 to angle outward at the openable hinges 310H, 322H (see FIG. 3). The tension bearing member 344 which is covered in the earth filling 702 but shown as though in an x-ray view in FIG. 6 is positioned in the upper half of the first sub-compartment 304 and preferentially restricts the outward expansion in the upper half of the first sub-compartment 304 leading to the tapered shape of the first sub-compartment 304 schematically represented in FIG. 6. As discussed above in certain embodiments the tension bearing member 344 has a length that exceeds the unstressed thickness T1 (See FIGS. 3-4) of the first sub-compartment 304. This longer length of the tension bearing member allows the upper middle of the first sub-compartment 304 (corresponding to the position of the tension bearing member 344) to expand under the pressure of the earth filling 702 so that the earth fill first sub-compartment 304 assumes a more stable configuration. Such stability is important during an initial period before the second sub-compartment 306 has been filled.

Figure 7:
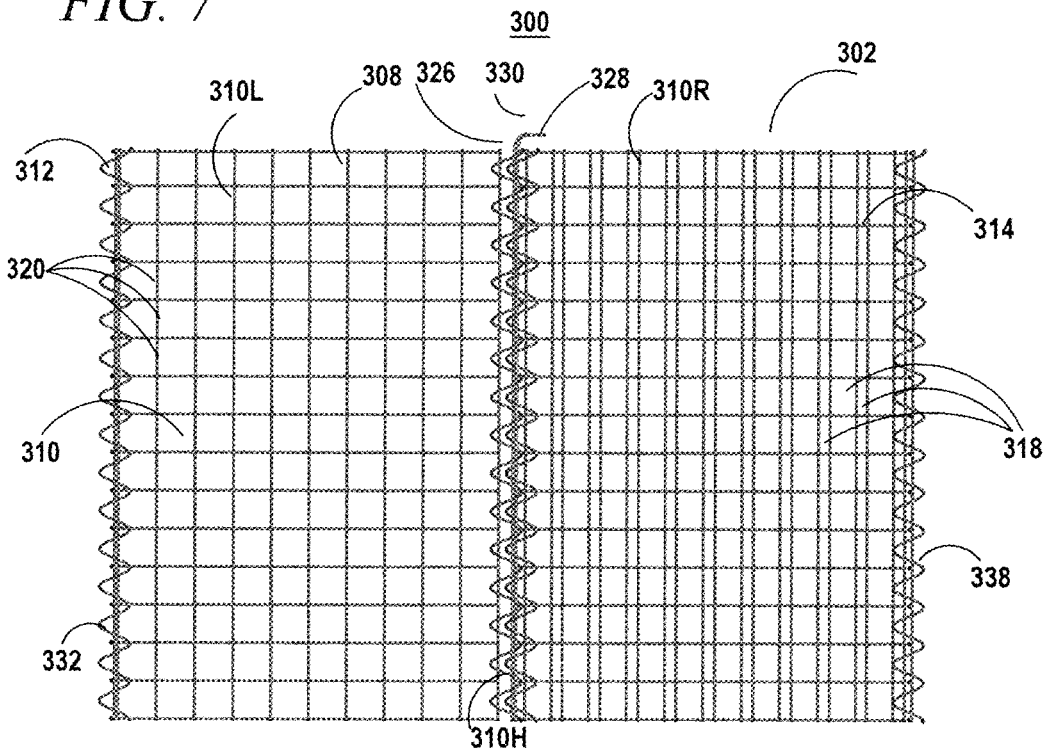
FIG. 7 is a front view of a metal framework of the revetment container compartment shown in FIG. 3.

FIG. 7 is a front view of the metal frame work 302 of revetment container compartment 300 shown in FIG. 3 without its fabric liner. As shown in FIG. 7 the front wall 310 includes the left front wall panel 310L and the right front wall panel 310R connected by the openable hinge 310H. The openable hinge 310H includes the left coil 326 which is threaded through the right edge of the left front wall panel 310R the right coil 328 which threaded through the left edge of the right front wall panel 310R and the front wall removable pin 330 which locks the left coil 326 and the right coil 328 together. Also visible in FIG. 7 is the front left coil spring 332 which couples the left front wall 310L to the left side wall 312 and the front right coil spring 338 which couples the right front wall panel 310R to the right side panel 314.

Figure 8:
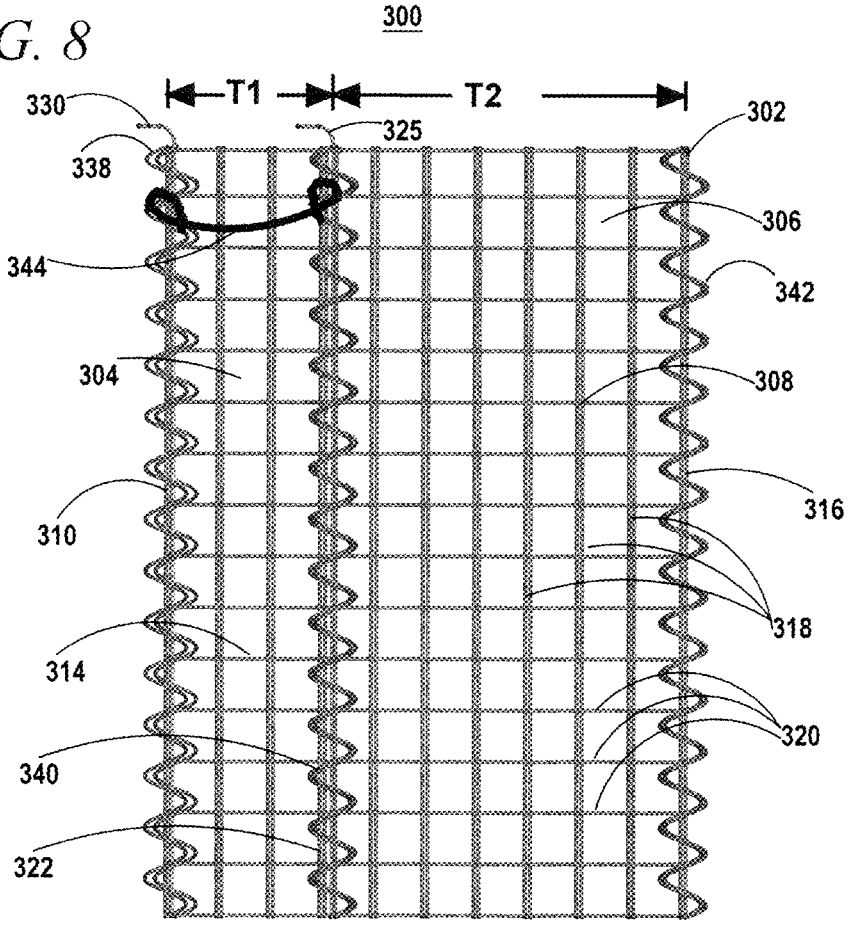
FIG. 8 is a side view of the metal framework of the revetment container compartment shown in FIG. 3.

FIG. 8 is a side view of the metal frame work 302 of the revetment container compartment 300 shown in FIG. 3. The first sub-compartment 304 having smaller thickness T1 is at the left in FIG. 8 and the second sub-compartment 306 having larger thickness T2 is at the right in FIG. 8. The tension bearing member 344 which couples the front wall 310 to the inner septum wall 322 is visible from the side in FIG. 8. As shown in FIG. 8 the tension bearing member 344 is not in a tension state and has a curved shape. The tension bearing member 344 may be a cord in which case due to its greater length relative to the unstressed state thickness T1 of the first sub-compartment, the tension bearing member 344 would assume a catenary shape. However in the case that the tension bearing member 344 is a wire, the tension bearing member may also initially be formed into an arc state and then when brought into tension when the first sub-compartment 304 is filled would assume a substantially straightened shape.

FIG. 9 is a perspective view of the metal framework 302 of the revetment container compartment 300 shown in FIG. 3 and FIG. 10 is a perspective view of two interconnected revetment container compartments such as shown in a top view in FIG. 4.

Figure 11:
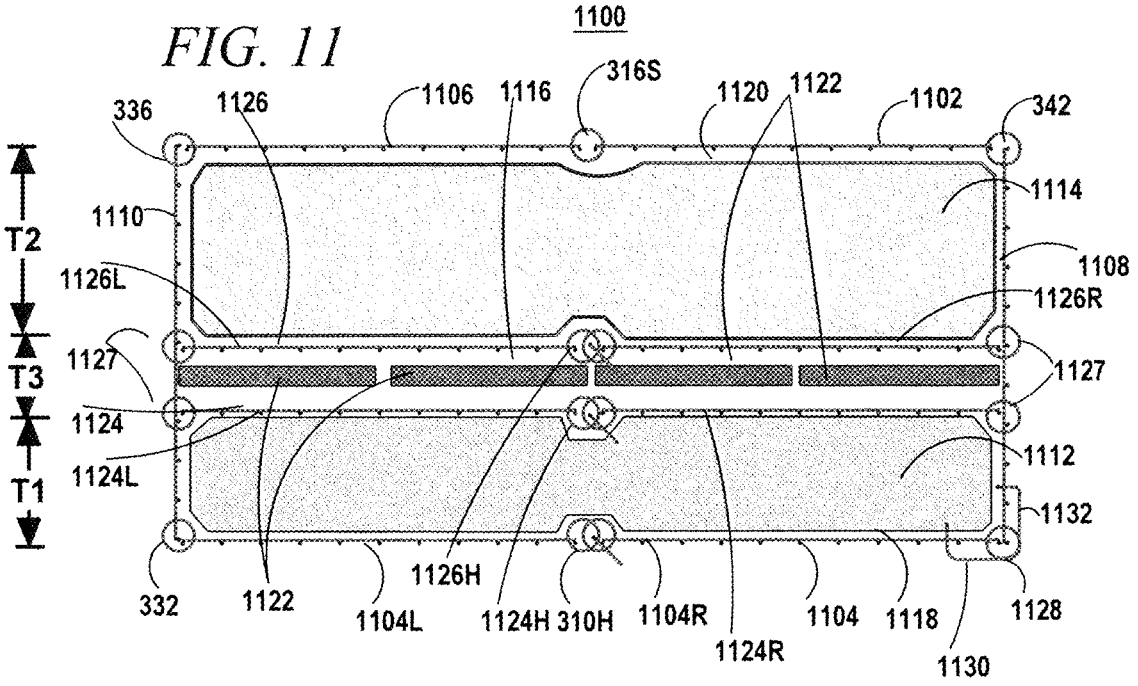
FIG. 11 is a top view of a revetment container compartment according to another embodiment of the invention.

FIG. 11 is a top view of a revetment container compartment 1100 according to another embodiment of the invention. The revetment container compartment 1100 has a peripheral wall 1102 that includes a front wall 1104 and a back wall 1106 which are connected by a left side wall 1110 and a right side wall 1108. The revetment container compartment 1100 may be connected together with other revetment container compartments (not shown) of the same or different design and the left side wall 1110 and/or right side wall 1108 may serve as a shared dividing wall between adjacent compartments. Certain elements of the revetment container compartment 1100 that are in common with the compartment 300 are identified by reference numbers used in the figures depicting the compartment 300 and in the foregoing description of the compartment 300.

The compartment 1100 is divided into a first sub-compartment 1112, a second sub-compartment 1114 and a third sub-compartment 1116. The third sub-compartment 1116 is disposed between the first sub-compartment 1112 and the second sub-compartment 1114. A first sub-compartment liner 1118 is disposed in the first sub-compartment 1112 and a second sub-compartment liner 1120 is disposed in the second sub-compartment 1114. The liners 1118, 1120 help in holding in earth or other materials placed in the first and second sub-compartments 1112, 1114 when the compartment 1100 is in use as part of a fortification wall.

The first sub-compartment 1112 is bounded by the front wall 1104 which in use may be arranged as the friendly side facing into a fortified area. As in the case of the embodiment described above the first sub-compartment 1112 has a first thickness T1 that may be lower than the thickness T2 of the second sub-compartment 1114. In use the first sub-compartment 1112 may be more quickly filled using shovels to obtain protection against small arms fire.

The third sub-compartment 1116 has a thickness T3 which may be lower than the thicknesses T1, T2 of the first and second sub-compartments 1112, 1114 respectively. The third sub-compartment 1116 may be sized to accommodate ballistic panels 1122 (or alternatively a single ballistic panel). When available, the ballistic panels 1122 may be placed into the third sub-compartment 1116 even more quickly than the time required to fill the first sub-compartment 1112 thus accelerating the process of attaining fortification against small arms fire. The ballistic panels 1122 may include, by way of nonlimiting example, Kevlar, ceramic, steel, aluminum and/or titanium.

The third sub-compartment 1116 is bounded by the right side wall 1108, the left side wall 1110, a first inner septum wall 1124 and a second inner septum wall 1126. The front wall 1104 includes a left panel 1104L and a right panel 1104R and a front wall openable hinge 310H constructed as described above. The first inner septum wall 1124 includes a left panel 1124L and a right panel 1124R. The first inner septum wall 1124 has a first inner septum wall openable hinge 1124H that connects the two panels 1124L, 1124R. The second inner septum wall 1126 also includes a left panel 1126L and a right panel 11268. The second inner septum wall 1126 has a second inner septum wall openable hinge 1126H that connects the left panel 1126L and the right panel 1126R. The left inner septum wall panels 1124L, 1126L and the right inner septum wall panels 1124R, 1126R are connected respectively to the right side wall 1108 and the left side wall 1110 by coils 1127. The inner septum wall openable hinges 1124H, 1126H are of the same construction as the openable hinge 310H described above. By opening the front wall openable hinge 310H and the first inner septum wall openable hinge 1124H soldiers can get access to the third sub-compartment 1116 and thus can place the ballistic panels 1122 in the third sub-compartment 1116 without having to lift the ballistic panels 1122 over the compartment 1100, an act which would potentially expose them to enemy surveillance or fire. By also opening the second inner septum wall openable hinge 1126H soldiers can access the second sub-compartment 1114.

In the case of the compartment 1100 a modified front right coil 1128 is provided. The front right coil 1128 serves to attach front right panel 1104R of the front wall 1104 to the right side wall 1108. In like manner to the front right coil 338 described above, the front right coil 1128 is threaded through the front right panel 1104R and the right side wall 1108 encircling vertically extending wires 318 thereby coupling the front right panel 1104R and the right side wall 1108. The front right coil 1128 also acts as a torsion spring and serves an additional function of spring biasing the front right panel 1104 into an open state. In the case that the openable hinge 310H of the front wall 1104 is closed the torque exerted by the front right coil 1128 will tend to bias the compartment 1100 into a flattened (collapsed) state suitable for storage. The front right coil 1128 is suitably made of a metal that may be heat treated to achieve a spring temper and at least a portion of the front right coil 1128 is suitably heat treated to achieve a spring temper. Alternatively the front right coil 1128 may be made of a non-metal resilient material.

Figure 12:
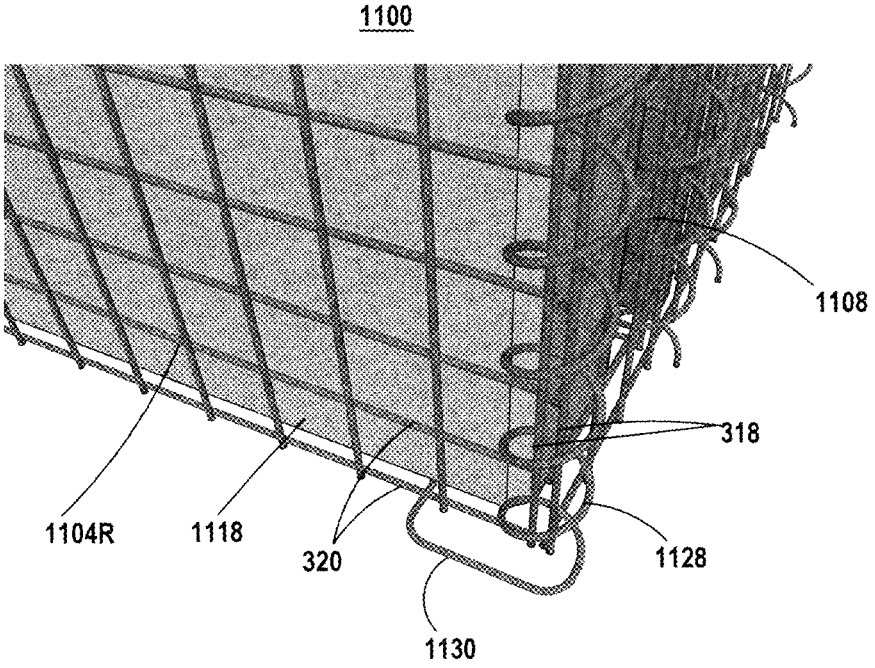
FIG. 12 is a close up perspective view of a lower front right corner of the revetment container compartment shown in FIG. 11 including a lower end of a torsion coil spring used to secure and spring bias an opening panel of the revetment container compartment.

FIG. 12 is a close up perspective view of a lower front right corner of the revetment container compartment 1100 including a lower end of the front right coil 1128. The front right coil 1128 includes a lower extending portion 1130 which extends along the front right panel 1104R for a distance and then bends under and up behind a lower the first sub-compartment liner 1118 and in back of one of the horizontally extending wires 320 of the front right panel 1104R.

Figure 13:
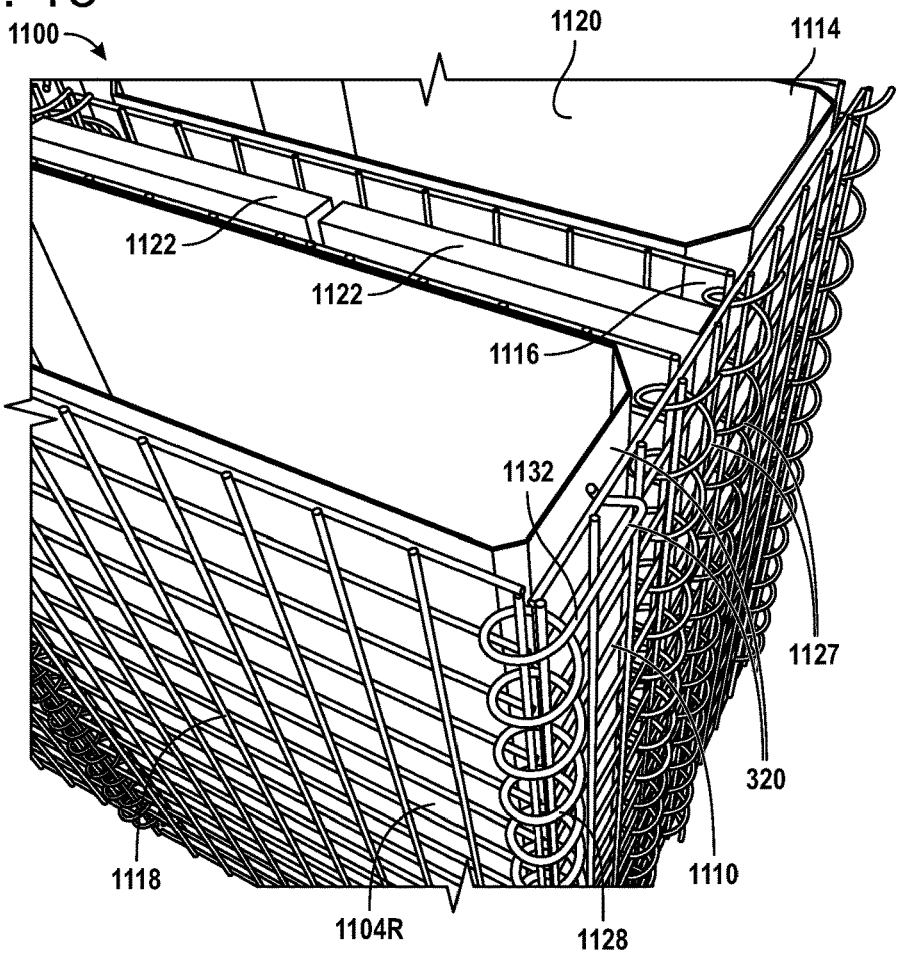
FIG. 13 is a close up perspective view of an upper front right corner of the revetment container compartment shown in FIG. 11 including an upper end of a torsion coil spring used to secure and spring bias an opening panel of the revetment container compartment.
Figure 14:
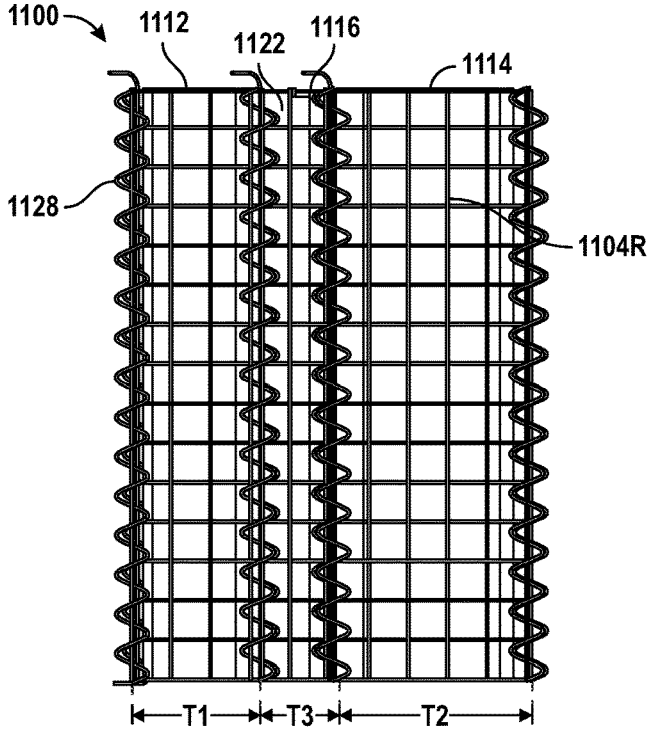
FIG. 14 is a side view of the revetment container compartment shown in FIGS. 11-13.
Figure 15:
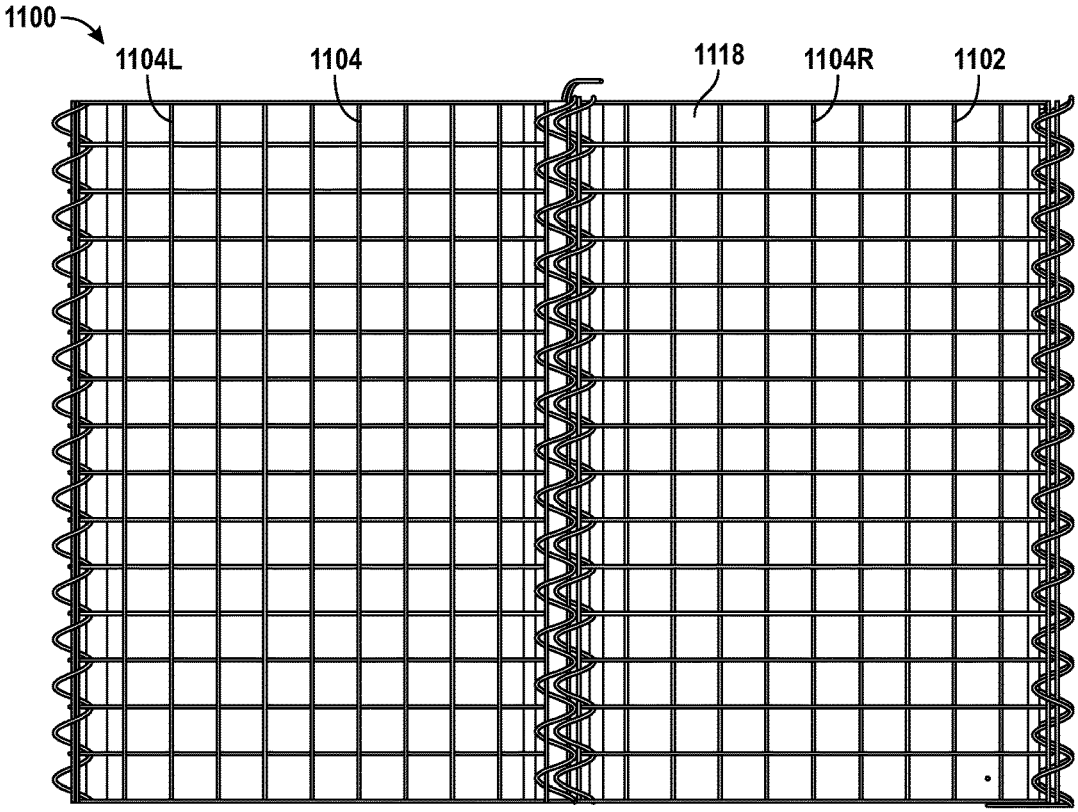
FIG. 15 is a front view of the revetment container compartment shown in FIGS. 11-14.
Figure 16:
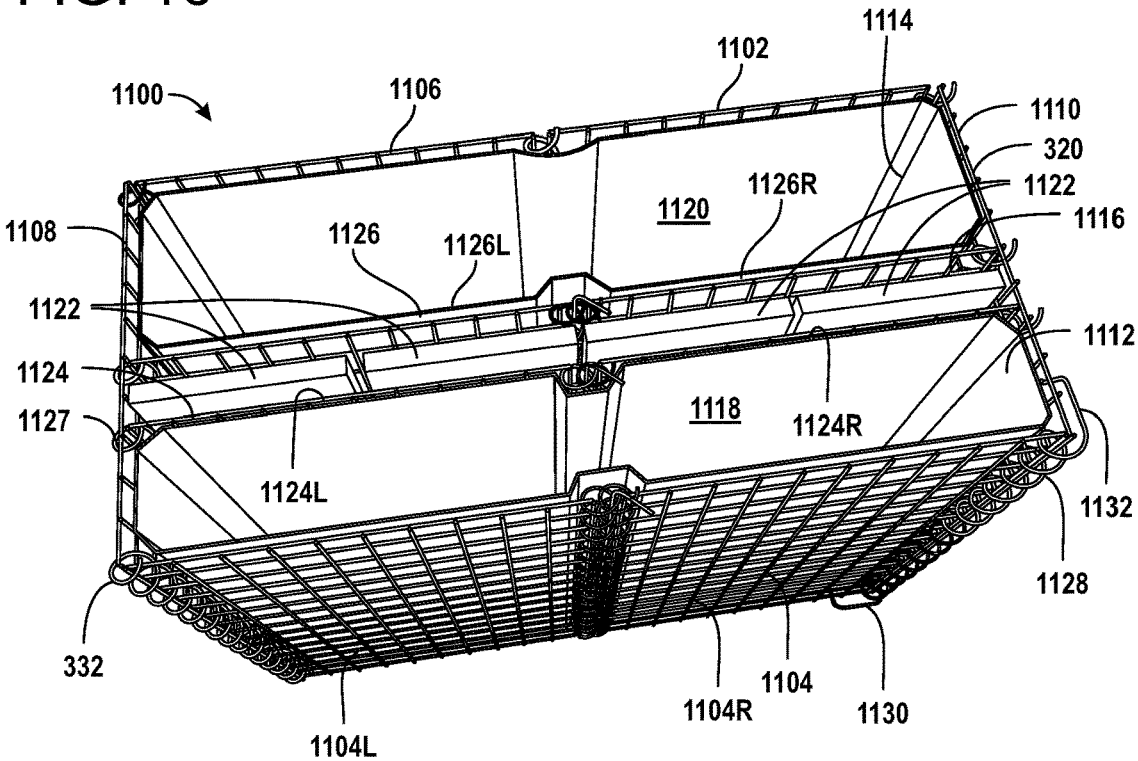
FIG. 16 is a perspective view of the revetment container compartment shown in FIGS. 11-15.

FIG. 13 is a close up perspective view of an upper front right corner of the revetment container compartment 1100 shown in FIG. 11 including an upper end of the front right coil 1128. The front right coil 1128 includes an upper extending portion 1132 which extends along the right side wall 1110 for a distance and then bends under and up behind one of the horizontally extending wires 320 of the right side wall 1110. Either or both of the lower extending portion 1130 and the upper extending portion 1132 can be heat treated to an annealed state so as to facilitate bending into the shapes shown in FIGS. 12-13. Either or both of the lower extending portion 1130 and the upper extending portion can be initially formed into a coil shape and after the front right coil 1128 has been threaded into position formed into the shape(s) shown in FIGS. 12-13. FIG. 14-16 show respectively a side view, a front view and a perspective view of the revetment container compartment shown in FIGS. 11-13. In the case that multiple compartments 1100 are joined in a sequence sharing side walls 1108, 1110, the upper extending portion may be engaged with the left panel 1104L of an adjoining compartment in lieu of being engaged with the right side wall 1110.

Figure 17:
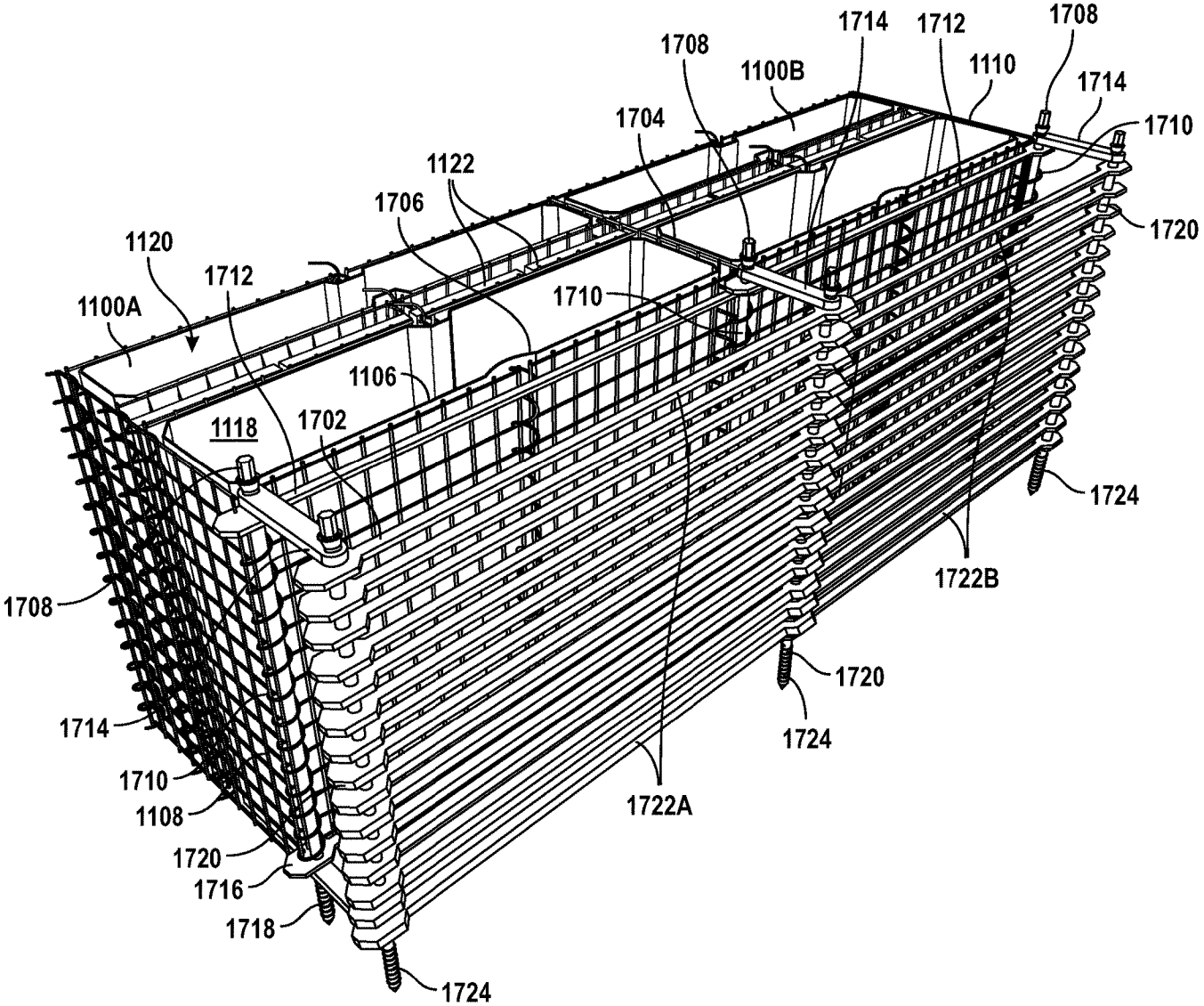
FIG. 17 is a perspective view of two interconnected revetment container compartments of the type shown in FIGS. 11-16 with added slat armor.

FIG. 17 is a perspective view of two interconnected revetment container compartments 1100A, 1100B of the type shown in FIGS. 11-16 with added slat armor 1702. A first compartment 1100A is siamesed together with a second compartment 1100B sharing a common side wall 1704. Although only two container compartments 1100A, 1100B are shown in FIGS. 17-20 for the purpose of illustration, in practice more than two compartments may be joined together in like manner to form a fortification wall. As shown in FIG. 17 slat armor 1702 is connected to a back side 1706 of the conjoined compartments 1100A, 1100B. The slat armor 1702 is connected to the compartments 1100A, 1100B by three coupling stakes 1708 that pass through back side coil springs 1710. The back side coil springs 1710 also serve the purpose previously described of connecting the back wall panels 1106 to side wall panels 1108, 1110 of the compartments 1100A, 1100B. In addition to passing through the center of the back side coil springs 1710, the three coupling stakes 1708 pass through three upper horizontal standoff struts 1714; two upper back side longitudinal struts 1712; two lower back side longitudinal struts 1716 and three lower horizontal standoff struts 1718. Each coupling stake 1708 passes through one upper horizontal standoff strut 1714 and one lower horizontal standoff strut 1718. Adjacent coupling stakes 1708 pass through opposite ends of the upper and lower back side longitudinal struts 1712, 1716. The coupling stakes 1708 pass through holes (not visible) in the struts 1712, 1714, 1716, 1718.

The upper and lower horizontal standoff struts 1714, 1718 extend away from the back side 1706 of the compartments 1100A, 1100B. Slat armor support stakes 1720 pass through ends of the horizontal standoff struts 1714, 1718 that are remote from the compartments 1100A, 1100B. The slat armor support stakes 1720 also pass through sets of slat armor bars 1722A, 1722B (a limited number of which are numbered to avoid crowding the drawing). A first set of slat armor bars 1722A extends between two slat armor support stakes 1720 behind the first compartment 1110A and a second set of slat armor bars 1722B extends between two slat armor stakes 1720 behind the second compartment 1100B. Bottom ends 1724 of the coupling stakes 1708 and slat armor support stakes 1720 are threaded to enhance gripping certain soils. Even prior to filling the sub-compartments 1118,1120 of the compartments 1100A, 1100B with soil, the ballistic panels 1122 and the slat armor 1702 will together provide a measure of protection against hostile small arms fire and munitions and such protection can be achieved relatively rapidly.

Figure 18:
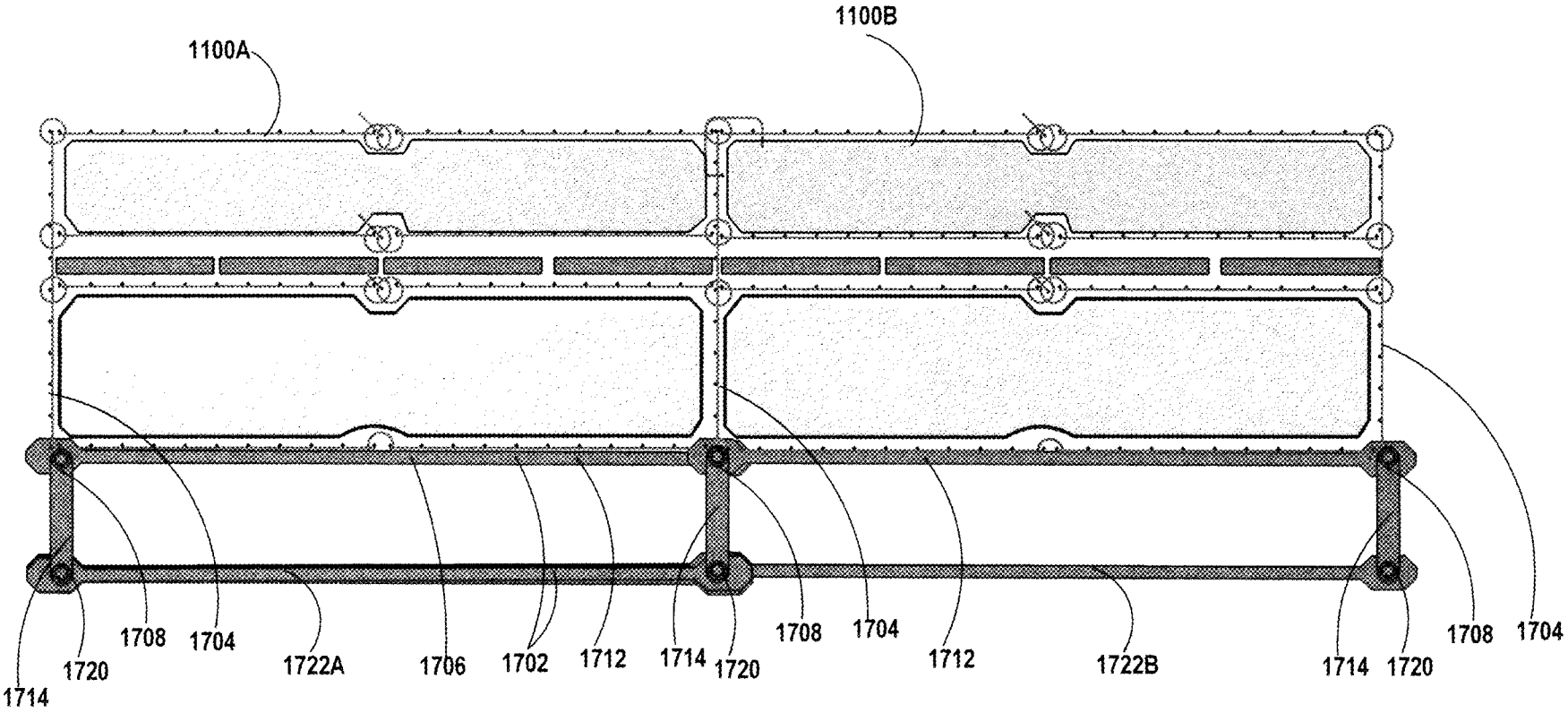
FIG. 18 is a top view of the two interconnected revetment container compartments with added slat armor shown in FIG. 17.
Figure 19:
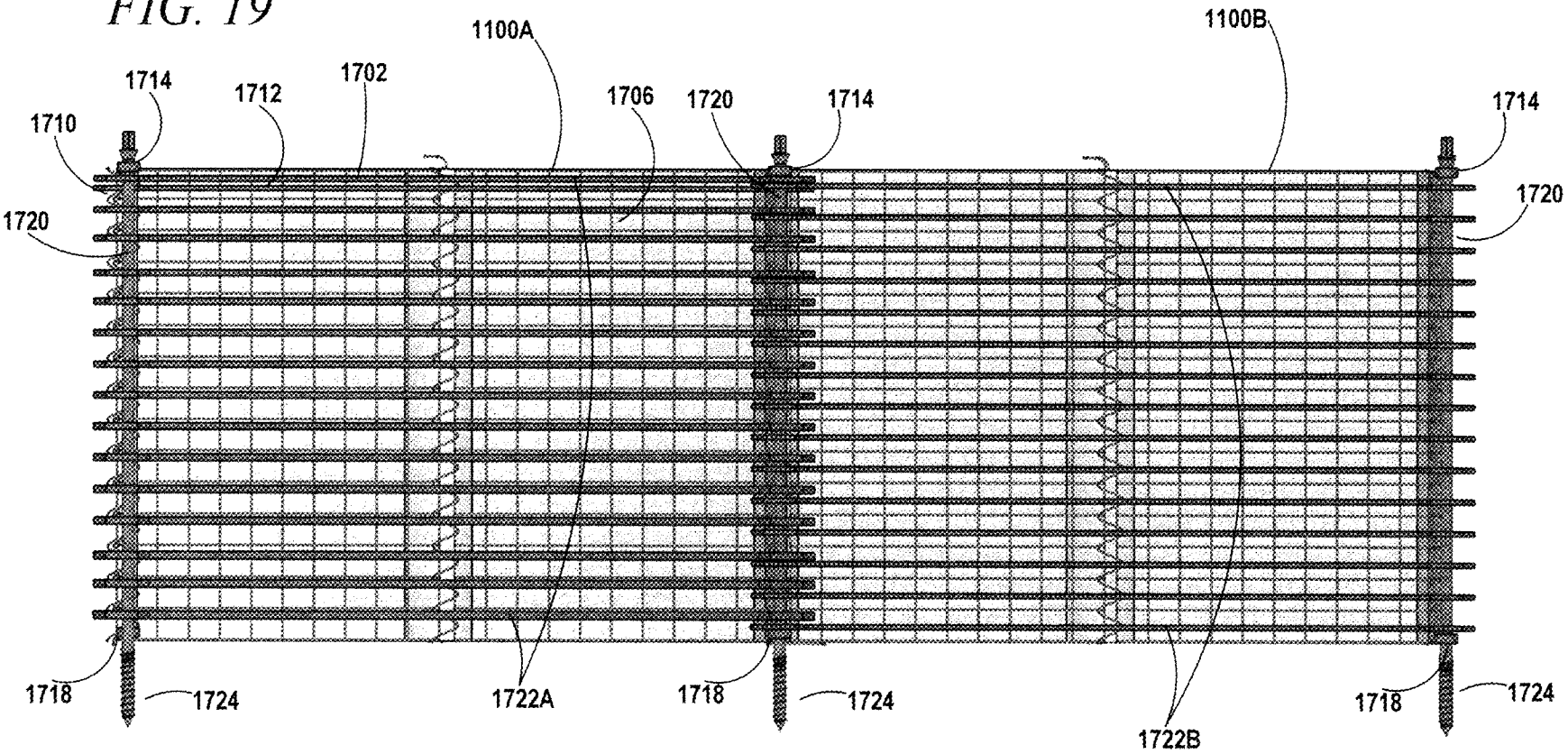
FIG. 19 is a rear view of the two interconnected revetment container compartments with added slat armor shown in FIGS. 17-18.
Figure 20:
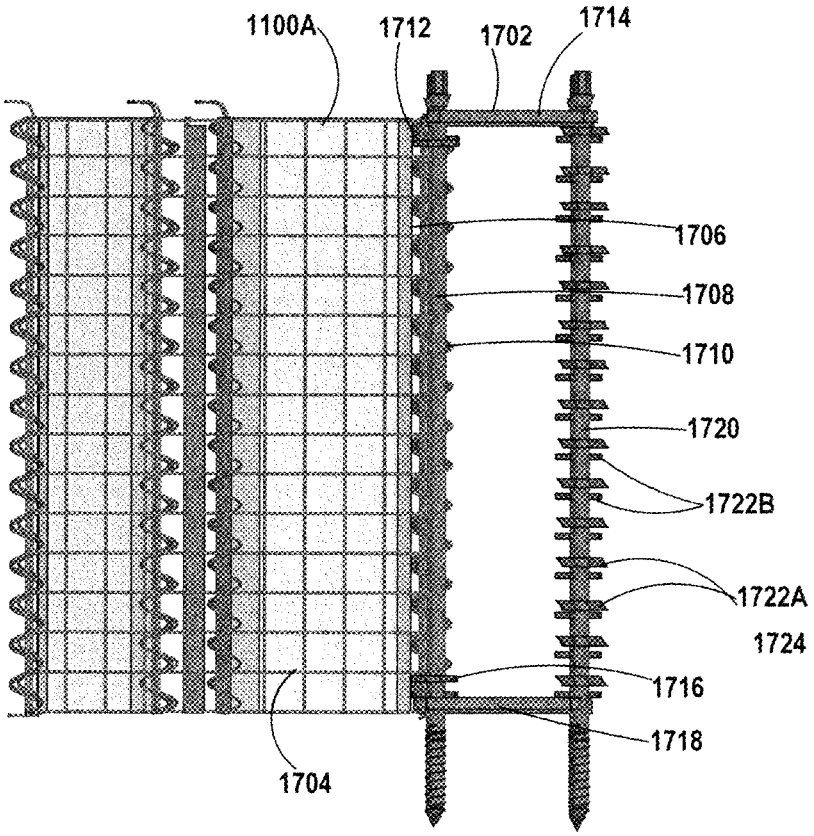
FIG. 20 is a side view of the two interconnected revetment container compartments with added slat armor shown in FIGS. 17-19.

FIGS. 18-20 show respectively a top view, a rear view and a side view of the two interconnected revetment container compartments 1100A, 1100B with added slat armor 1702 shown in FIG. 17.

It will be further understood that various changes in the details, materials, and arrangements of the parts which have been described and illustrated in order to explain embodiments of this invention may be made by those skilled in the art without departing from embodiments of the invention encompassed by the following claims.

In this specification including any claims, the term "each" may be used to refer to one or more specified characteristics of a plurality of previously recited elements or steps. When used with the open-ended term "comprising," the recitation of the term "each" does not exclude additional, unrecited elements or steps. Thus, it will be understood that an apparatus may have additional, unrecited elements and a method may have additional, unrecited steps, where the additional, unrecited elements or steps do not have the one or more specified characteristics.

It should be understood that the steps of the exemplary methods set forth herein are not necessarily required to be performed in the order described, and the order of the steps of such methods should be understood to be merely exemplary. Likewise, additional steps may be included in such methods, and certain steps may be omitted or combined, in methods consistent with various embodiments of the invention.

Although the elements in the following method claims, if any, are recited in a particular sequence with corresponding labeling, unless the claim recitations otherwise imply a particular sequence for implementing some or all of those elements, those elements are not necessarily intended to be limited to being implemented in that particular sequence.

All documents mentioned herein are hereby incorporated by reference in their entirety or alternatively to provide the disclosure for which they were specifically relied upon.

Reference herein to "one embodiment" or "an embodiment" means that a particular feature, structure, or characteristic described in connection with the embodiment can be included in at least one embodiment of the invention. The appearances of the phrase "in one embodiment" in various places in the specification are not necessarily all referring to the same embodiment, nor are separate or alternative embodiments necessarily mutually exclusive of other embodiments. The same applies to the term "implementation."

The embodiments covered by the claims in this application are limited to embodiments that (1) are enabled by this specification and (2) correspond to statutory subject matter. Non-enabled embodiments and embodiments that correspond to non-statutory subject matter are explicitly disclaimed even if they fall within the scope of the claims.

What is claimed is:

1. A revetment container comprising:

at least one compartment defined by at least one peripheral wall and an internal septum wall within the at least one peripheral wall, the internal septum wall dividing the at least one compartment into a first sub-compartment having a first thickness between the internal septum wall and a first wall portion of the at least one peripheral wall and a second sub-compartment having a second thickness between the internal septum wall and a second wall portion of the at least one peripheral wall, wherein the first thickness is less than the second thickness, and a tension bearing member connected between the first wall portion of the at least one peripheral wall and the internal septum wall, the tension bearing member serving to limit growth of the first thickness when the revetment container is filled, wherein the at least one compartment includes a plurality of compartments coupled together via a common wall between each pair of adjacent compartments, wherein at least two of the plurality of compartments share a compartment dividing wall, wherein the compartment dividing wall forms a part of the at least one peripheral wall of each of the at least two of the plurality of compartments; and wherein the internal septum wall comprises a first internal septum wall portion and a second internal septum wall portion and an openable hinge between the first internal septum wall portion and the second internal septum wall portion, the openable hinge being openable to permit access between the first sub-compartment and the second sub-compartment.

2. The revetment container according to claim 1 wherein the openable hinge comprises a first helical wire.

3. The revetment container according to claim 2 wherein the openable hinge comprises a second helical wire and a removable hinge pin coupling the first helical wire and the second helical wire.

4. The revetment container according to claim 1 wherein the at least one peripheral wall comprises a first metal lattice.

5. The revetment container according to claim 4 wherein the at least one peripheral wall comprises a first liner adjacent to the first metal lattice.

6. The revetment container according to claim 5 wherein the internal septum wall comprises a second metal lattice and a second liner adjacent to the second metal lattice.

7. The revetment container according to claim 1 having a height and wherein the tension bearing member is coupled to the first wall portion of the at least one peripheral wall and the septum wall within an upper half of the height of the revetment container, whereby growth of the first thickness is limited in the upper half of the height of the revetment container.

8. The revetment container according to claim 1 wherein the at least one peripheral wall includes a portion extending from the internal septum wall in a direction parallel to the first thickness direction, the portion having a thickness direction dimension, and wherein the tension bearing member has a tension bearing member length between the internal septum wall and the first wall portion and the tension bearing member length exceeds the thickness direction dimension of the portion by between 15% and 25%.

9. The revetment container according to claim 1 wherein the tension bearing member comprises a cord connected between the internal septum wall and the first wall portion.

10. The revetment container according to claim 1 wherein the internal septum wall is coupled to the compartment dividing wall.

11. The revetment container according to claim 10 wherein the internal septum wall is coupled to the compartment dividing wall through a helical wire.

12. The revetment container according to claim 1 wherein the internal septum wall is disposed substantially parallel to and spaced from the first wall portion and the second wall portion.

13. A revetment container comprising:

a first compartment and a second compartment, a dividing wall between the first compartment and the second compartment, a multi-panel side wall spanning the first compartment and the second compartment, a first internal septum wall disposed in the first compartment forming a first sub-compartment in the first compartment, a second internal septum wall disposed in the second compartment forming a second sub-compartment in the second compartment wherein the first sub-compartment is bounded by the multi-panel side wall and the second sub-compartment is bounded by the multi-panel side wall, a first tension bearing member connected between the first internal septum wall and the multi-panel side wall, and a second tension bearing member connected between the second internal septum wall and the multi-panel side wall, a portion of the dividing wall bounding the first sub-compartment and the second sub-compartment, wherein the first tension bearing member has a first tension bearing member length between the first internal septum wall and the multi-panel side wall that exceeds a dimension of the portion of the dividing wall extending between the first internal septum wall and the multi-panel side wall and wherein the second tension bearing member has a second tension bearing member length between the second internal septum wall and the multi-panel side wall that exceeds a dimension of the portion of the dividing wall extending between the second internal septum wall and the multi-panel side wall.

14. The revetment container according to claim 13 wherein the multi-panel side wall includes a first portion bounding the first compartment and the first sub-compartment is coextensive with the first portion of the multi-panel side wall.

15. The revetment container according to claim 14 wherein the first portion of the multi-panel side wall includes a pair of first portion panels connected by a side wall hinge.

16. The revetment container according to claim 15 wherein the multi-panel side wall comprises a side wall metal lattice and the first internal septum comprises a septum metal lattice.

17. The revetment container according to claim 15 wherein the first internal septum wall comprises a pair of first internal septum wall portions connected by a septum wall hinge which is openable to permit access to the first sub-compartment from another sub-compartment of the first compartment on an opposite side of the first internal septum wall from the first sub-compartment.

18. The revetment container according to claim 17 wherein the side wall hinge comprises a first side wall helical wire and the septum wall hinge comprises a first septum wall helical wire.

19. The revetment container according to claim 17 wherein the side wall hinge comprises a second side wall helical wire and a side wall removable pin passing through the first and second side wall helical wires and the septum wall hinge comprises a second septum wall helical wire and a septum wall removable pin passing through the first and second septum wall helical wires.

20. A fortification wall component comprising a compartment having a peripheral wall for holding in materials and a set of slat armor coupled to the compartment and disposed in spaced relation to the compartment, the compartment comprising:

an internal septum wall within the peripheral wall, the internal septum wall dividing the compartment into a first sub-compartment having a first thickness between the internal septum wall and a first wall portion of the peripheral wall and a second sub-compartment having a second thickness between the internal septum wall and a second wall portion of the peripheral wall; and a tension bearing member connected between the first wall portion of the at least one peripheral wall and the internal septum wall.

21. The fortification wall component according to claim 20 wherein the peripheral wall includes a first panel, a second panel, and a coil spring wound through the first panel and second panel coupling the first panel to the second panel, the fortification wall component further comprising a first stake disposed in the coil spring and a strut coupled to the first stake and coupled to the set of slat armor.

22. The fortification wall component according to claim 21 further comprising a second stake coupled to the strut and coupled to the set of slat armor.

* * * * *